United States Patent [19]

Musinski

[11] Patent Number: 4,611,474

[45] Date of Patent: Sep. 16, 1986

[54] MICROMINIATURE REFRIGERATOR

[75] Inventor: Donald L. Musinski, Saline, Mich.

[73] Assignee: KMS Fusion, Inc., Ann Arbor, Mich.

[21] Appl. No.: 610,322

[22] Filed: May 14, 1984

[51] Int. Cl.[4] ..... F25B 19/00

[52] U.S. Cl. ..... 62/514 R; 165/104.21; 165/168; 165/185

[58] Field of Search ..... 62/6, 514 R, 45; 165/168, 185, 104.21

[56] References Cited

U.S. PATENT DOCUMENTS 3,661,542 5/1972 Collins ..... 62/45
3,815,575 6/1974 Davis ..... 165/104.21
4,359,872 11/1982 Goldowsky ..... 62/6
4,386,505 6/1983 Little ..... 62/514 R
4,392,362 7/1983 Little ..... 62/514 R

*Primary Examiner*—Ronald C. Capossela

[57] ABSTRACT

A microminiature refrigerator or cryocooler which comprises three flat rectangular plates forming a laminate assembly. Passages are formed as opposed channels in the outer plates for routing refrigerant to and from a refrigerator chamber. The intermediate plate comprises a plurality of hollow spherical shells which are positioned between the opposed channels of the outer plates. Each shell contains a volatile working fluid for enhancing refrigerant heat exchange between the opposing channels.

9 Claims, 7 Drawing Figures

MICROMINIATURE REFRIGERATOR

The present invention is directed to microminiature refrigerators. More specifically, the invention is directed to improvements in microminiature cryocoolers of the type shown in U.S. Pat. Nos. 4,386,505 and 4,392,362.

BACKGROUND AND OBJECTS OF THE INVENTION

Microminiature refrigerators of the type illustrated in the aforementioned patents essentially comprise a laminated assembly having micron-sized fluid passages formed in outer plates of glass or the like separated from each other by an intermediate layer. Heat conduction requirements for such intermediate layer are essentially conflicting in that it must have high conductivity across its thickness to facilitate heat exchange between inlet and outlet fluid passages, but must have low conductivity lengthwise to facilitate maintenance of one end at cryogenic temperatures. It is a general object of the present invention to provide an improved intermediate layer having enhanced heat conductivity across its thickness while maintaining high lengthwise insulation capacity.

Another object of the invention is to provide a microminiature refrigerator of the desired type in which heat exchange characteristics of the intermediate layer are specifically adapted to the design operating temperature of the refrigerator.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
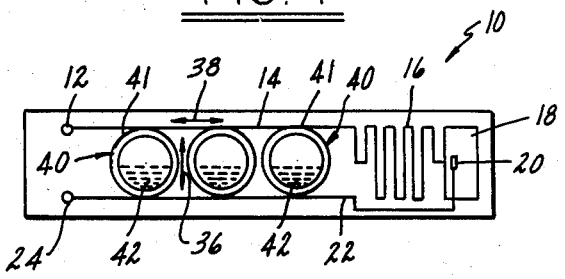
FIG. 1 is a schematic diagram of a microminiature refrigerator in accordance with the invention.
Figure 2:
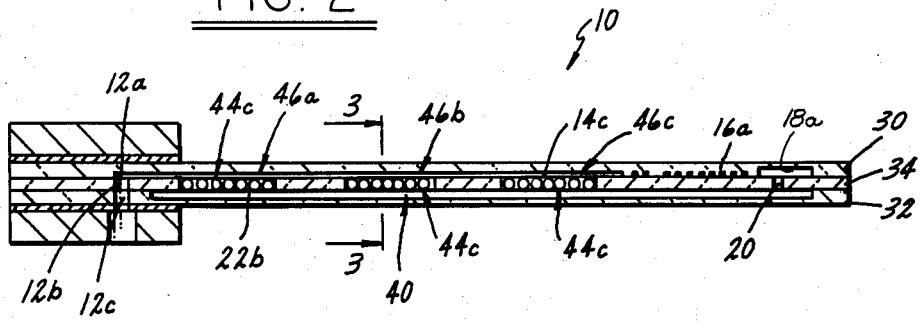
FIG. 2 is a sectioned elevational view longitudinally bisecting a microminiature refrigerator in accordance with the invention.

FIG. 1 is a schematic illustration of a refrigerator 10. An inlet port 12 is adapted for connection to admit a highly compressed refrigerant to a passage having a heat exchange portion 14 and a capillary section 16 of smaller cross section. Capillary section 16 terminates in a cooling chamber 18. An outlet 20 from chamber 18 is connected to a return passage 22 and thence to an outlet port 24 for routing refrigerant to external condensing and compressing means (not shown). In general, as shown in FIGS. 2–6, passage heat exchange section 14, capillary section 16 and chamber 18 are etched or otherwise formed in one surface of a plate 30 which forms one outside layer of the laminated refrigerator assembly. Outlet passage 22 is formed on an opposing face of a second plate 32 which forms the other outside layer. An intermediate plate 34 is bonded to and separates plates 30, 32 from each other, and includes passage 20 for connecting chamber 18 to passage 22 in assembly.

The functional and structural requirements of intermediate plate 34 are conflicting. For refrigerator 10 to function as intended, plate 34 must permit efficient heat exchange in the direction 36 in FIG. 1 between inlet heat exchange passage 14 and outlet passage 22. On the other hand, while the longitudinal end of the refrigerator which contains ports 12, 24 may be at or near room temperature, the opposing end at chamber 18 may be at cryogenic temperatures of a few degrees K. Thus, all layer plates 30–34 should have poor heat conductive properties in the longitudinal direction 38 (FIG. 1). In the aforementioned patents, which are incorporated herein by reference, plate 34 is of solid homogeneous glass construction, having relatively poor heat conduction properties, and is made thin in the direction 36 to maximize heat exchange. However, substantial pressure differentials between passages 14, 22 limit minimum thickness, thereby limiting such heat exchange and overall refrigerator efficiency. In general, in accordance with the present invention, a plurality of micro-sized heat pipes, comprising hollow spherical shells 40 having a volatile working fluid 42 contained therein, are positioned in plate 34 to enhance heat exchange between passages 14, 22 in the direction 36 while maintaining required strength in the direction 36 and poor heat conduction properties in the direction 38. Use of fluid-filled shells as micro-sized heat pipes in general applications is the subject of the copending application of the inventor herein, Ser. No. 568,216 filed Dec. 30, 1983 and assigned to the assignee hereof. The disclosure of such application is incorporated herein by reference.

Figure 3:
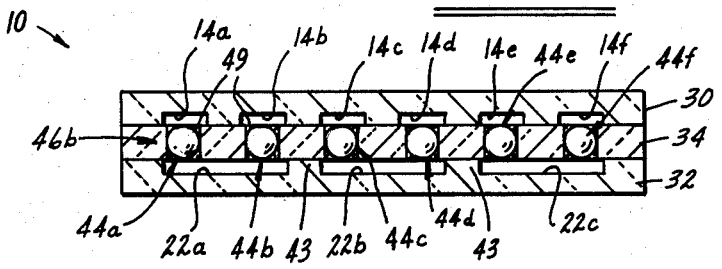
FIG. 3 is a sectional view taken along the line 3—3 in FIG. 2.

Referring in greater detail to FIGS. 2–7, plate 30 comprises a flat rectangular sheet of glass or other suitable composition having a plurality of laterally spaced longitudinally extending parallel channels 14*a*–14*f* etched or otherwise formed therein. Adjacent ends of each channel 14*a*--14*f* are connected together to a circular pocket 12*a*. The opposing ends of channels 14*a*–14*f* are connected together to a serpentine channel 16*a* which forms capillary section 16. It will be noted in FIG. 4 that channel 16*a* is of substantially lesser dimension in the plane of plate 30 than is each or all of the channels 14*a*–14*f*. Capillary channel 16*a* terminates in plate 30 at a rectangular pocket 18*a* which forms chamber 18. Plate 32 is likewise a flat rectangular sheet of glass or other suitable composition having three relatively wide channels 22*a*, 22*b*, 22*c* formed lengthwise therein and separated from each other by the longitudinal support ribs 43. In the lateral direction, and as best seen in FIG. 3, ribs 43 in plate 32 align in assembly with the regions between channels 14*b*, 14*c* and 14*d*, 14*e* in plate 30. Thus, channels 14*a*, 14*b* align with and oppose channel 22*a*, channels 14*c*, 14*d* align with and oppose channel 22*b*, and channels 14*e* 14*f* align with and oppose channel 22*c* across the thickness of plate 34. Channels 22*a*, 22*b*, 22*c* have a common end which communicates with pocket 18*a* through outlet 20 in plate 34. The opposing end of each channel 22*a*, 22*b*, 22*c* is connected in plate 32 to an opening 24*a* which forms outlet port 24. A second opening 12*c* in plate 32 aligns in assembly with a through-passage 12*b* in plate 34 and pocket 12*a* in plate 30 to form inlet port 12. Plates 30, 32, 34 are pressure bonded to each other in any suitable manner.

In accordance with the preferred embodiment of the invention illustrated in the drawings, a plurality of microsized heat pipes 40 are disposed in a structured array within intermediate plate 34 to facilitate heat transfer from passage 14 to passage 22 in plates 30, 32. Each heat pipe 40 comprises a closed hollow spherical shell 41 internally capturing a volatile working fluid 42. Shells 41 are disposed within plate 34 in a plurality of linear arrays 44 parallel to each other and to the longitudinal dimension of refrigerator 10, and laterally separated from each other so as to be disposed in assembly between opposed channels in plates 30, 32. For example, referring to FIG. 3, linear shell arrays 44*a* and 44*b* are respectively positioned in assembly between channels 14*a* and 14*b* in plate 30 and channel 22*a* in plate 32. Likewise, linear shell arrays 44*c*, 44*d* are positioned between channels 14*c*, 14*d* and channel 22*b*, and the arrays 44*e*, 44*f* are positioned between channels 14*e*, 14*f* and channel 22*c*. In operation, refrigerant is admitted through port 12 at high pressure and room temperature, and travels through passage section 14 toward capillary section 16. Refrigerant returning through passage 22 to outlet port 24 is at much lower temperature and pressure. Thus, heat is exchanged across shells 41 by heating and evaporation of working fluid 42 adjacent to passage section 14, transport of working fluid 42 across the shells in gaseous phase, recondensation within the shells adjacent to passage 22, and return in liquid phase along the shell walls.

It will be appreciated that such heat exhange causes the temperature of refrigerant in passage 14 to drop as it approaches capillary section 16, and the temperature of refrigerant in passage 22 to rise between chamber 18 and port 24. Working fluid 42 and the pressure thereof within within shells 41 must, of course, be chosen to evaporate and condense at the design operating temperatures in the respective passages 22, 14. In accordance with a particularly preferred feature of the invention, shell arrays 44 are grouped in zones lengthwise of plate 34, three zones 46*a*, 46*b*, 46*c* being illustrated in the drawings. Most preferably, the working fluid contained within the shell heat pipes within each zone 46*a*–46*c* is selected as a function of the temperatures of the refrigerant at the area of the passages 14, 22 and the temperature differential therebetween. For example, in zone 46*c* closest to chamber 18, where the temperature of the refrigerant is lowest in both passages 14, 22, working fluid 42 is chosen to have high volatilization and low condensation temperatures, and may comprise hydrogen, deuterium or hydrogen-deuterium, for example, which are suitable for operation from 15° K. up to about 40° K. Neon, argon, nitrogen and oxygen, which also have high volatilization but higher condensation temperatures, are suitable for zones 46*b* and 46*a* where refrigerant temperature is higher.

Figure 7:
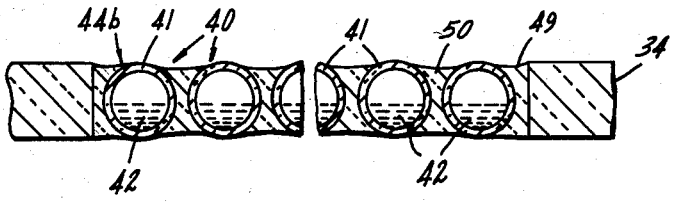
FIG. 7 is a fragmentary sectional view on an enlarged scale taken substantially along the line 7—7 in FIG. 5.
Figure 4:
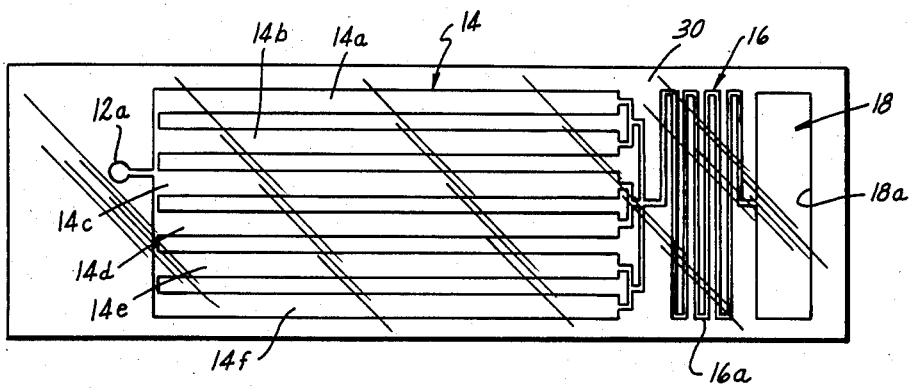
FIGS. 4–6 respective plan views of the individual layers which constitute the refrigerator of FIGS. 2 and 3.
Figure 5:
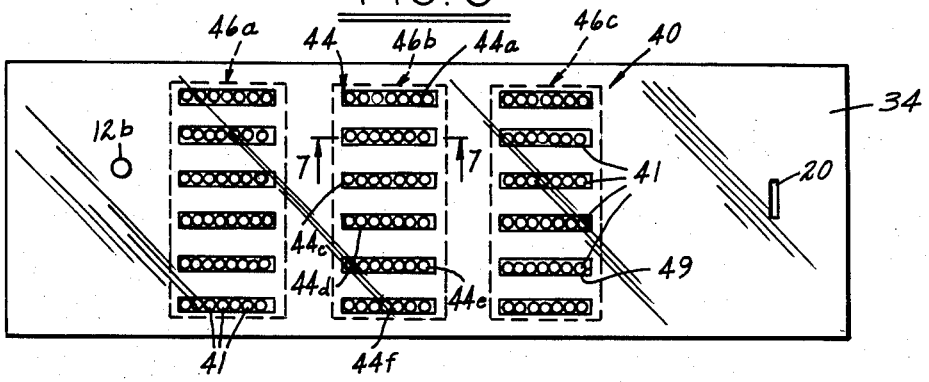
Figure 6:
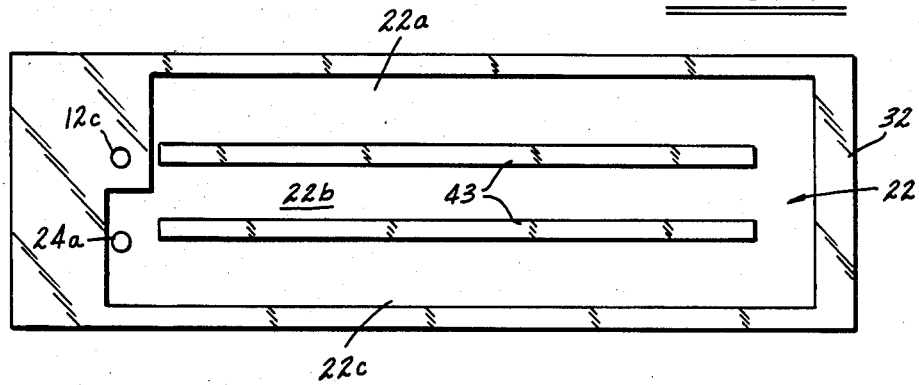

In manufacture, plate 34 first has the opening 12*b* 20 and a plurality of rectangular through-slots 49 formed therein in a row and column array corresponding to the lateral positions of arrays 44*a*–44*f* and the longitudinal positions of zones 46*a*–46*c*. Shells 40, which are preferably of silicate glass composition, are preformed in any suitable manner. Techniques such as those disclosed in U.S. Pat. Nos. 4,017,290, 4,201,253, 4,336,338 and 4,340,407 are suitable. The preformed shells are suspended in a glass sol-gel, metal-organic-gel, solder glass or other suitable solution, and the slurry is applied to the slots 49 in plate 34 as a fluid mixture. The glass solution may include a wetting agent. The fluid gel and suspended shells are held within the plate slots by surface tension, and the gel allowed or forced to harden into a glassy matrix 50 (FIG. 7). Plate 34 is then fired to rigidify matrix 50 which holds the shells within plate 34.

Shells 41 may be prefilled with working fluid and the composite structure fired under pressure. Alternatively, shells 40 may be filled after assembly. In either event, the shells are preferably filled in accordance with the technique disclosed in U.S. Pat. No. 4,432,933 which contemplates placement of the shells in an atmosphere of working fluid vapor at elevated temperature and pressure, less than the softening temperature of the shell material, for a period of time sufficient to permit permeation of the vapor through the wall of each shell and into the shell interior. Temperature and pressure are thereafter decreased effectively to entrap the working fluid within the shells.

Preferably, shells 41 have an outside diameter equal to the thickness of plate 34, which permits direct contact of refrigerant with the shell wall. However, it is contemplated for applications having high pressure differential across plate 34 that a multiplicity of smaller shells may be employed, with the material of matrix 50 serving to conduct heat between successive shells. Where the diameter of shells 41 is equal to the thickness of plate 34, as shown in the drawings, the width of slots 49 is preferably slightly greater than shell diameter. In any event, the width of slots 49 laterally of plate 34 should be such as to locate each shell array 44 between its associated pair of opposing channels in plates 30, 32.

Thus each shell 41 and each linear array of shells 44 serves as an efficient heat conductor between an opposing pair of refrigerant passage-channels. This heat conduction is particularly efficient where shell diameter approximates the thickness of plate 34 so that the refrigerant directly contacts the shell walls. Provision of shells 41 also increases heat conductivity in the longitudinal direction even when the shells are separated by the material of matrix 50 (FIG. 7). However, such undesirable longitudinal heat conductivity increase is minimal when compared with increase between inlet and outlet refrigerant passage-channels, thus yielding a substantial net increase in efficiency.

The invention claimed is:

1. In a microminiature refrigerator which includes a laminate assembly having a first plate with a channel forming a high pressure refrigerant inlet passage on an inner face thereof, a second plate with a channel forming a low pressure refrigerant return passage on the inner face thereof, and an intermediate plate separating said inlet and outlet passage channels from each other, the improvement for enhancing heat exchange between said inlet and outlet passages comprising at least one hollow spherical shell carried by said plate between said channels in heat transfer communication with refrigerant in said channels, and a volatile working fluid captured within said shell.

2. The refrigerator set forth in claim 1 wherein each of said first and second plates includes a plurality of channels aligned with each other in pairs across said third plate, and wherein said improvement comprises at least one said fluid-capturing shell carried by said third plate between each pair of said channels aligned across said third plate.

3. The refrigerator set forth in claim 2 wherein each of said first and second plates comprises a plurality of spaced parallel channels aligned with each other in pairs across said third plate, and wherein said improvement comprises a plurality of said fluid-capturing shells between each said pair of channels aligned across said third plate.

4. In a microminiature refrigerator which comprises a laminate assembly including a flat rectangular first plate having a first plurality of laterally spaced parallel channels extending longitudinally along one face thereof, a flat rectangular second plate having a second plurality of laterally spaced parallel channels extending longitudinally along a face thereof opposed to said one face, with said channels in said first plate being arranged in opposed pairs with said channels in said second plate, a flat rectangular third plate separating said first and second plates from each other, means at one longitudinal end of said plates forming refrigerant inlet and outlet means, and means at an opposing longitudinal end of said plates forming a refrigeration chamber in fluid communication with said channels through said third plate, the improvement comprising a plurality of hollow spherical shells carried by said third plate between opposed pairs of said channels for heat-transfer contact with refrigerant passing therethrough, and a volatile working fluid captured within each of said shells.

5. The refrigerator set forth in claim 4 wherein said fluid-capturing shells are disposed in laterally spaced longitudinally extending arrays, one such array being disposed between each said pair of opposed channels.

6. The refrigerator set forth in claim 5 wherein each said shell array comprises a plurality of longitudinally distinct shell arrays, shells in each said longitudinally distinct array containing a different working fluid.

7. The refrigerator set forth in claim 5 wherein said plates and said shells are of silicate glass composition.

8. In a microminiature refrigerator which comprises a laminate assembly including a flat rectangular first plate having a first plurality of laterally spaced parallel channels extending longitudinally along one face thereof, a flat rectangular second plate having a second plurality of laterally spaced parallel channels extending longitudinally along a face thereof opposed to said one face, with said channels in said first plate being arranged in opposed pairs with said channels in said second plate, a flat rectangular third plate separating said first and second plates from each other, means at one longitudinal end of said plates forming refrigerant inlet and outlet means, and means at an opposing longitudinal end of said plates forming a refrigeration chamber in fluid communication with said channels through said third plate, the improvement comprising a plurality of discrete heat conductive means carried by said third plate and extending between opposed pairs of said channels for heat-transfer contact with refrigerant passing therethrough, said plurality of discrete heat conductive means being separated from each other in the longitudinal direction of said third plate.

9. The refrigerator set forth in claim 8 wherein said discrete heat conductive means are disposed in laterally spaced longitudinally extending arrays, one such array being disposed between each said pair of opposed channels.

* * * * *